US006200179B1

(12) United States Patent
Widmann et al.

(10) Patent No.: US 6,200,179 B1
(45) Date of Patent: Mar. 13, 2001

(54) DIESEL WET EXHAUST PROCESSING SYSTEM

(75) Inventors: George F Widmann; Bobby J. Payne, both of Palm Harbor, FL (US)

(73) Assignee: ECO Sound Inc., Tardon Springs, FL (US)

( * ) Notice: Subject to any disclaimer, the term of this patent is extended or adjusted under 35 U.S.C. 154(b) by 0 days.

(21) Appl. No.: 09/452,013

(22) Filed: Nov. 30, 1999

(51) Int. Cl.[7] ..... B63H 21/32
(52) U.S. Cl. ..... 440/89
(58) Field of Search ..... 440/89, 88; 181/235, 181/280; 60/310, 274

(56) References Cited

U.S. PATENT DOCUMENTS

| | | | |
|---|---|---|---|
| 1,142,073 | 6/1915 | Wolff . | |
| 1,823,301 | 9/1931 | Walker . | |
| 2,612,745 | 10/1952 | Vecchio . | |
| 3,282,047 | 11/1966 | Wertheimer . | |
| 3,296,997 | 1/1967 | Hoiby . | |
| 3,815,328 | 6/1974 | Moss | 55/93 |
| 4,559,068 | 12/1985 | Lagerstedt | 55/399 |
| 4,941,896 | 7/1990 | Gustavsson et al. | 55/95 |
| 5,022,877 | 6/1991 | Harbert | 440/89 |
| 5,196,655 | 3/1993 | Woods | 181/235 |
| 5,284,451 | 2/1994 | Chiu | 440/89 |
| 5,453,107 | 9/1995 | Liu | 55/255 |
| 5,550,337 * | 8/1996 | Tazuki et al. | 440/89 |
| 5,554,058 | 9/1996 | LeQuire | 440/89 |
| 5,746,630 | 5/1998 | Ford et al. | 440/89 |
| 5,857,324 | 1/1999 | Scappatura et al. | 60/274 |
| 6,024,617 * | 2/2000 | Smullin et al. | 440/89 |

* cited by examiner

*Primary Examiner*—Jesus D. Sotelo
(74) *Attorney, Agent, or Firm*—Harold D. Shall

(57) ABSTRACT

A container for receiving wet exhaust from a deisel engine into an inlet pipe leading into the container. The inlet pipe has a closed bottom and slot in the side thereof intermediate the top and bottom for discharging exhaust into the container. The container has a false bottom spaced above its closed bottom with a fluid access opening in the false bottom. An overflow pipe extends from below the false bottom to a location above the latter and then out the side of the container; this pipe controlling the water level within the container. A pump out pipe is disposed with its inlet end at this water level and removes sheen from the surface of the water to a location outside of the container.

5 Claims, 5 Drawing Sheets

DIESEL WET EXHAUST PROCESSING SYSTEM

BACKGROUND OF THE INVENTION

1. Field of the Invention

The present invention relates generally to structures for processing wet exhaust from diesel engines and more particularly to devices for quieting the exhaust and for removing the water and other impurities from the wet exhaust gases by entrapping them in a water bath so that cleaner gases are discharged into the atmosphere while the device removes the sheen, excess water, and impurities from the water bath so that fairly clean water is discharged from the device.

2. Description of Prior Art

U.S. Pat. No. 5,746,630 discloses a housing having a tangential inlet for inducting exhaust flow and a first outlet for dried exhaust gas and a second outlet near the bottom for draining water from the housing. U.S. Pat. Nos. 5,196,655; 5,554,058; and other patents also shows a muffler device for silencing exhaust and removing impurities. However, none of these devices does it in the manner of or as well as my invention.

SUMMARY OF THE INVENTION

The present invention includes a container for receiving diesel engine wet exhaust through an inlet tube having a slot therein intermediate the ends thereof. The lower portion of the container has a false bottom therein which has an access opening therethrough in fluid communication with the portion of container above the false bottom. The wet exhaust gases enter the container above the false bottom and a pool of water overlying the false bottom and extending into the false bottom entraps water, oil and particles from the incoming exhaust gases in the portion thereof above the false bottom while an exhaust outlet above the water level carries "cleaned" exhaust gases form the unit. Oil and particles, such as carbon from the exhaust are entrapped as a layer of sheen on top of the water pool and a pick up tube confluent with the surface of the pool removes these impurities for further processing in another device not a part of this invention. A water over-flow tube, which extends from below the false bottom to a level above the lower end of the pick up tube, drains excess "cleaned" water from the pool at the bottom thereof and discharges the water from the device to thereby control the water level of the pool and discharge "clean" water. In a first embodiment angled baffle plates in the water pool above the false bottom are impinged upon by the circulating water so that oil and other particle matters are forced to the surface of the water as a layer of sheen which is picked up by the pick-up tube. A second embodiment utilizes a weir and dam arrangement to force the sheen to the surface so that the pick up tube may withdraw the sheen from the surface.

DETAILED DESCRIPTION OF THE PREFERRED EMBODIMENT

Figure 1:
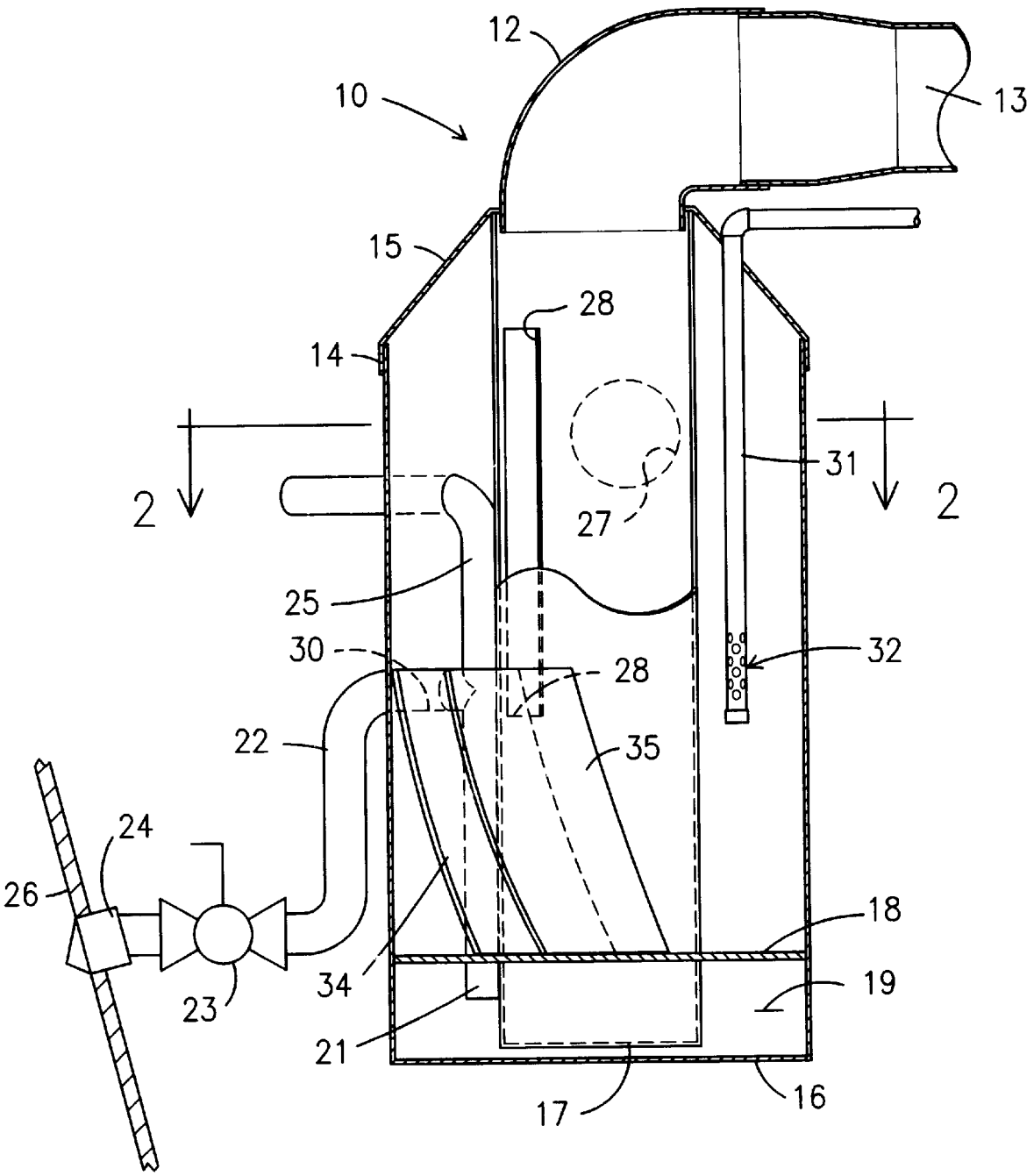
FIG. 1 is a front elevational view of a first embodiment of this invention which is shown partially in section and partially broken away.
Figure 2:
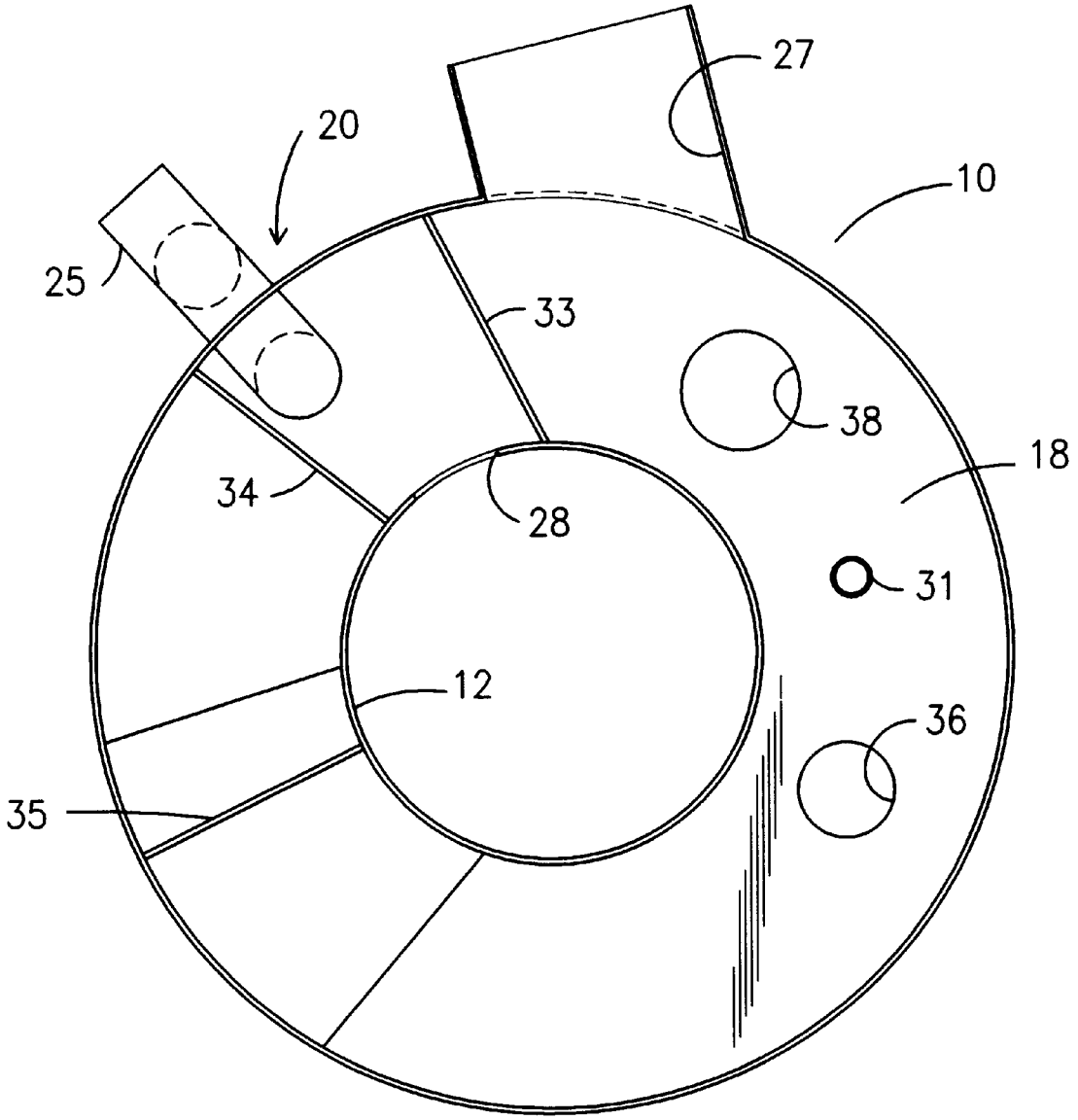
FIG. 2 is a cross sectional view taken along the lines 2—2 in FIG. 1.

Referring now to the drawings, and more particularly FIGS. 1 and 2, a diesel wet exhaust processing system (ESP) is shown generally at 10 and has an exhaust receiving pipe 12 connected to the wet exhaust manifold of a diesel engine shown fragmentarily at 13. The exhaust receiving pipe 12 extends downardly and into a cylindrical housing 14 forming the external wall of the ESP 10. The top of the housings 14 is in the form of a truncated cone 15 intimately secured to the housing 14 as by welding and the bottom 16 thereof is flat and also intimately secured to the housing as by welding. The pipe 12 is spaced from the housing 14 and extends to lie close to the bottom 16 and the lower end of the pipe is closed as shown at 17.

A false annular bottom 18 is secured in the housing 14 and spaced above the bottom 16 sufficiently to form a lower reservoir 19 therebetween. The lower end of the pipe 12 extends through the false bottom so that the lower end 17 of the pipe is below the false bottom. The height of the water within the housing 14 is controlled by an overflow pipe shown generally at 20, which pipe has a lower segment 21 extending from below and through the false bottom, 18 to a location slightly below the midpoint of the housing 14. The lower segment is connected to a laterally and then downwardly extending segment 22 which has a conventional ball type stopcock 23 therein from which a discharge line 24 extends out of the hull of a vessel 26. A vent pipe 25 confluently extends upwardly from the lower segment 21 and serves as a conventional vent for the overflow pipe 20.

An exhaust discharge pipe 27 extends from the housing 14 at a location above the top of the lower segment 21 of the overflow pipe 20 and conducts dried "cleaned" exhaust out of the system 10. An axially elongated and vertically extending discharge slot 28 is formed in the pipe 12 and extends vertically from a location just above the exhaust discharge opening downwardly so that its lower end is on a line with the inner bottom 30 of the upper portion of the lateral segment over the over flow pipe 20, such inner bottom 30 being the determinant of the water level within the housing 14.

A vacuum tube 31 extends into the housing 14 and has a plurality of small sucking openings 32 at the water level in the housing 14. A conventional vacuum device (not shown) draws the contaminants on the surface of the reservoir within the housing 14 out of the device 10. The vacuum device is preferably cycled on and off as needed. These contaminants are then directed to an oil/water separator which is not a part of this invention. A radially extending barrier member 33 extends from the top of the false bottom 18 to the inside of the top of the housing 14 and its lateral outer edge is secured to the inside of the housing 14 and its lateral inner edge is secured to the periphery of the pipe 12. When exhaust enters the system 10 through receiving pipe 12, it is discharged radially outwardly into the housing 14 through the slot 28. As seen in FIG. 2, the barrier 33 prevents the exhaust from going clockwise and thus it moves counter clockwise entirely about the interior of the housing through the exhaust discharge 27. During this travel, the velocity of the gasses decreases substantially and most of the oil and particulate contaminates therein fall upon the surface of the water in the housing. The counter clockwise movement of the exhaust gases, in their engagement with the surface of the water urges the water to also rotate counter clockwise.

Angle plates 34 and 35 are secured to the inner surface of the housing 14 and to the outer surface of the exhaust pipe 12 at their lateral edges, and to the false bottom 18 on their bottom edges. The top edges are free and are coterminous with the top of the lateral segment 22. These plates are angled upwardly in a clockwise direction, as seen in FIGS. 1 and 2, and when the counterclockwise moving water engages the same, any oil or particles therein move up the inclined plates and form a sheen on the top of the oil which is then removed by vacuum tube 31.

A pair of drain holes 36 and 38 are formed in the false bottom 18 and the water from the reservoir above the false bottom moves through these holes and into the reservoir 19 therebelow. This cleaned water is then discharged from the system through the overflow pipe 20.

Referring now to FIGS. 3 to 9, a second embodiment of this system is shown generally at 36 and includes upper and lower housing surfaces 37 and 38, respectively, with each of these secured to a hollow cylindrical portion 39 forming a housing 39A. A false bottom 40 is secured to the portion housing 39 in a spaced relationship with the lower surface 38 and a short pipe or transfer tube 41 extends through the false bottom 40 and projects slightly above and below the same to confluently connect the upper and lower portions of the system 36. An exhaust receiving pipe 42 from a wet exhaust manifold (not shown) extends from above the system and through the upper surface 37 thereof and terminates at its lower closed end immediately above the false bottom 40. The pipe 42 has a slot 43 which is below the surface 37 and extends circumferentially through the periphery of the pipe 42 for approximately 180 degrees. The slot, as shown is approximately ⅙ the vertical height of the portion of the pipe 42 below the surface 37.

Figure 4:
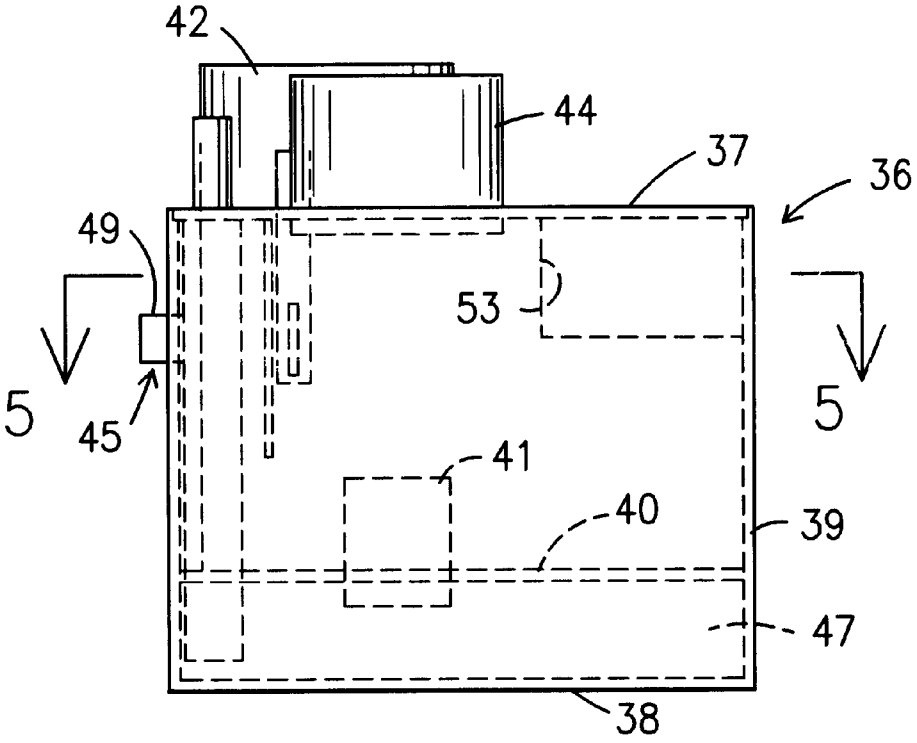
FIG. 4 is a side elevational view of the device of FIG. 3.
Figure 6:
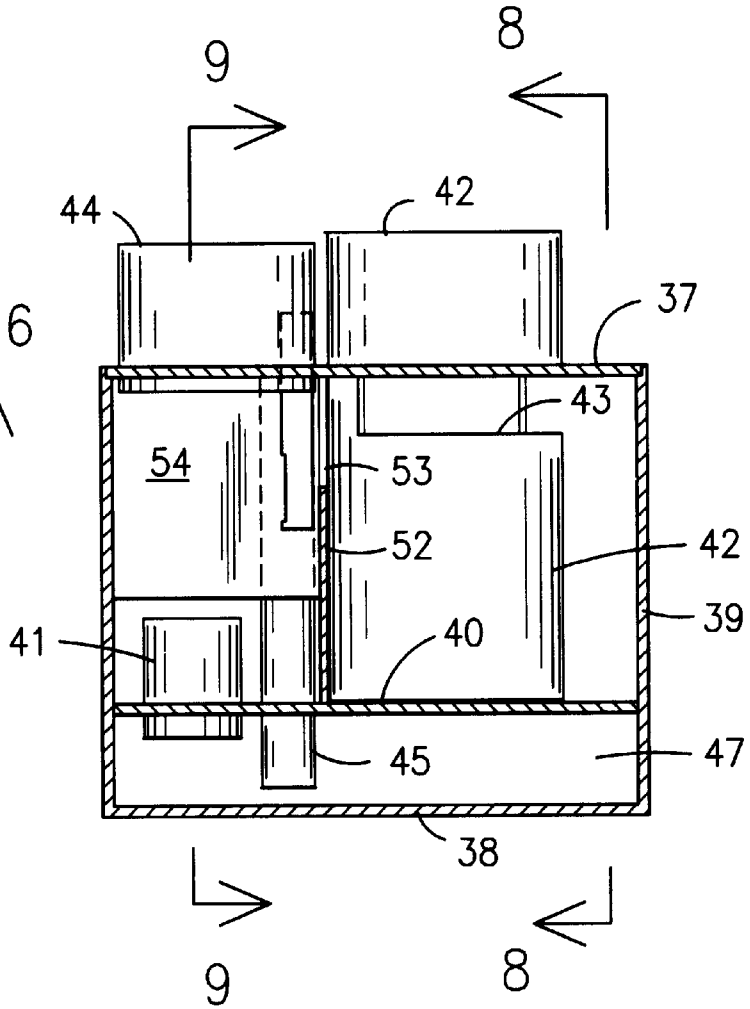
FIG. 6 is a cross sectional view taken along the lines 6—6 in FIG. 5.
Figure 9:
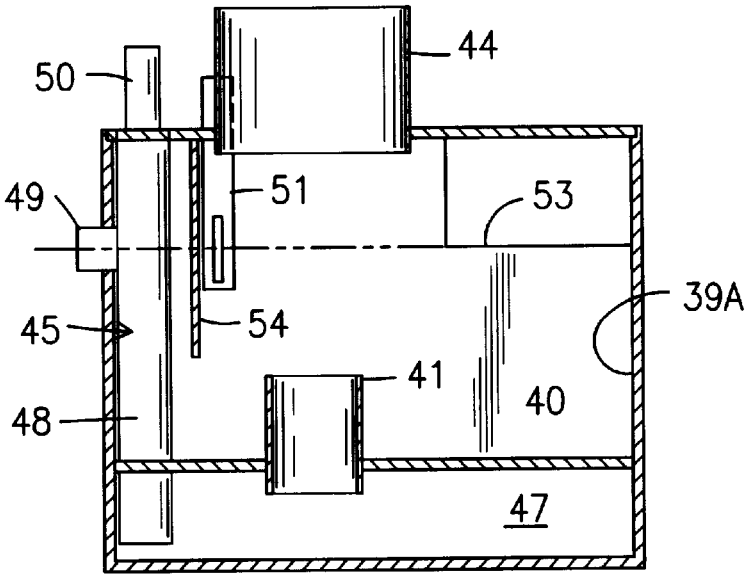

An exhaust outlet pipe 44 for the system 36 extends into the housing 39A through the upper surface 37 and projects confluently into the housing for a relatively short distance as seen in FIGS. 4, 6 and 9. An over-flow pipe 45 extends from the reservoir 47 below the false bottom 40 and spaced from the bottom 38 and extends out of the top of the housing 39A. The over-flow pipe has a lower portion 48, a lateral portion 49 and a vent portion 50; the lateral portion 49 extending the into the housing 39A a distance so that it overlaps the water level in the housing 39A an amount which is controlled by the overflow pipe 45.

Figure 3:
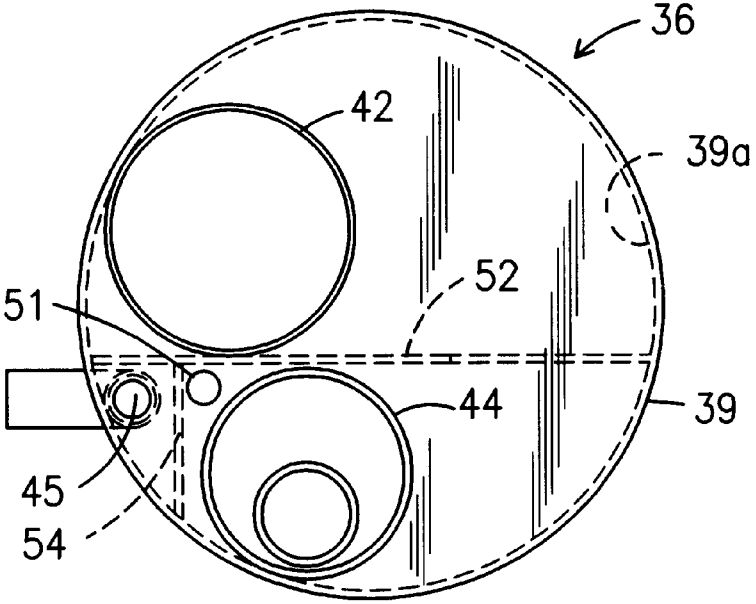
FIG. 3 is a plan view of a second embodiment of this invention.
Figure 5:
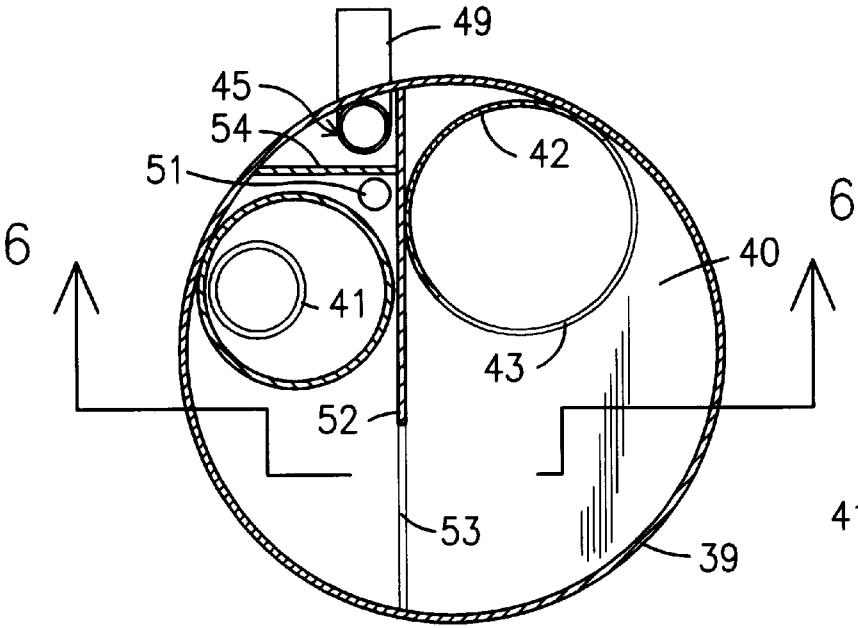
FIG. 5 is a cross sectional view taken along the lines 5—5 in FIG. 4.
Figure 7:
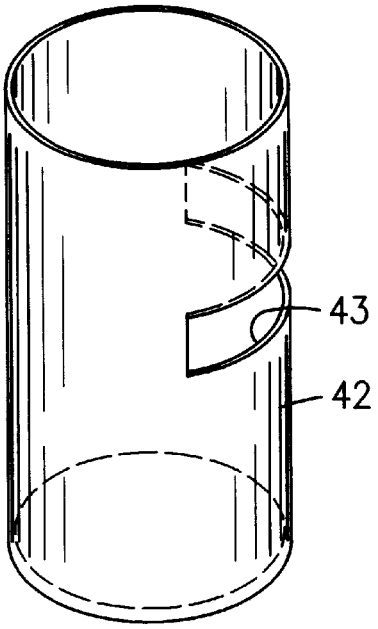
FIG. 7 is an isometric view of the exhaust receiving pipe.
Figure 8:
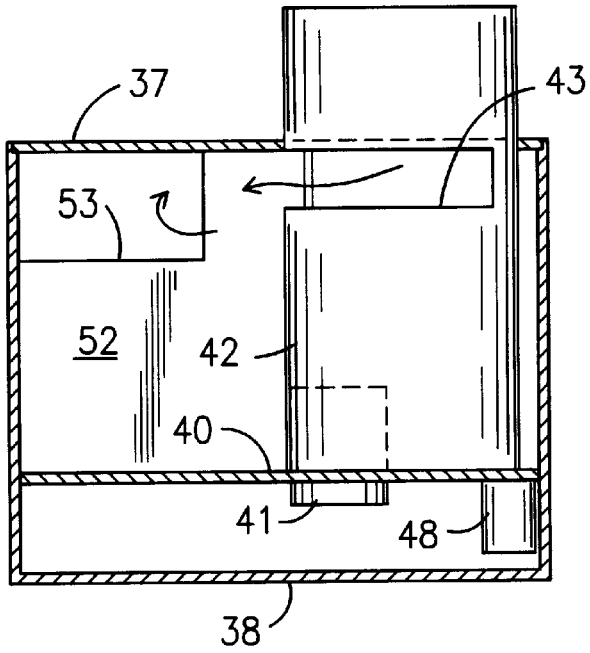
FIGS. 8 and 9 are cross sectional views taken along the lines 8—8 and 9—9, respectively, in FIG. 6.

A main wall 52 extends cordially across the housing 39A at a location between the exhaust inlet and the exhaust outlet and is laterally secured at both its lateral ends to the cylindrical portion 39 and vertically secured at the top thereof to the upper wall 37. The lower side of the main wall 52 rests on and is secured to the top of the false bottom 40 and the wall has an opening 53 therethrough at the outer top thereof which, as seen in FIGS. 3 and 5, and is located clockwise from the slot 43, the latter slot being directed toward the inner surface of the cylindrical portion 39 at a location counter clockwise of the opening 53. A secondary wall 54 is secured to the wall 52 and extends cordially therefrom to the inner surface of the housing 39 and extends vertically downwardly from the upper surface 37 to location below the vacuum tube 51 (see FIG. 9).

Wet exhaust gases enter the system 36 through the slot 43 in the exhaust receiving pipe 42. This exhaust cannot move counter clockwise because of the wall 52 and does move clockwise through the opening 53 in the wall 52 and then out through the exhaust outlet pipe 44; the wall 54 preventing further clockwise movement of the exhaust. The water, oil and particulate waste in the exhaust is deposited on the water and forms a sheen on the water as the water moves clockwise. The sheen developed on the surface of the water moves clockwise with the water through the opening 53 in the plate 52 until the surface of the water with the sheen thereon abuts the wall 54. The sheen is withdrawn periodically, by the vacuum tube 51 which is positioned just counterclockwise of wall 54. Substantially clean water is withdrawn from the reservoir 47 through the overflow pipe 45 and discharged overboard through the vessel's hull While the preferred embodiments have been shown and described, many changes can be Made therein without departing from the scope of this invention as defined by the following claims.

What is claimed is:

1. A wet exhaust processing system comprising in combination,

A) an annular cylinder having a closed top, a closed bottom, and a false bottom spaced above said closed bottom, 1) said false bottom having an access opening therein for providing fluid passage therethrough, B) a wet exhaust input pipe 1) extending into said cylinder through the closed top thereof, 2) having a closed lower end, and 3) having a slot means formed therein in the portion of said pipe within said cylinder, C) a water overflow pipe extending from below said false bottom in an upward direction and exiting said cylinder at a location intermediate said closed top and said false bottom, 1) said overflow pipe dictating the water level within said cylinder by draining water from below said false bottom, D) an exhaust discharge pipe confluently connected to said annular cylinder at a location above said overflow pipe and circumferentially spaced from said input pipe, F) plate means in said cylinder extending vertically from said false bottom to said closed top and circumferentially positioned between said input pipe and said discharge pipe for forcing exhaust from said input pipe to move circumferentially in only one direction to said discharge pipe, and G) a pump out line for pumping sheen off the surface of the water in said cylinder.

2. A system according to claim 1 wherein said pump out line has inlet openings, said overflow pipe has a first portion extending upwardly from below said false bottom, a second portion extending laterally from said first portion through said annular cylinder, and a third portion extending downwardly from said second portion, and said pump out line inlet openings are positioned generally in the same horizontal plane as said second portion.

3. A system according to claim 2 wherein said slot means is vertically elongated and has a bottom end, and said bottom end terminates generally in the same horizontal plane as said pump out line inlet openings.

4. A system according to claim 2 including angle plate means secured to said cylinder, said false bottom and to said input pipe, and extending vertically upwardly from said false bottom and terminating at the upper end thereof generally in the same horizontal plane as said pump out line inlet openings.

5. A system according to claim 1 wherein said slot means is circumferentially elongated.

* * * * *